US009633503B2

(12) United States Patent
Roekens et al.

(10) Patent No.: US 9,633,503 B2
(45) Date of Patent: Apr. 25, 2017

(54) VENDOR

(75) Inventors: Jurgen Roekens, Kampenhout (BE); Antonio Feltrin, Castelletto Monferato (IT); Willy Van Esch, Grez-Doiceau (BE)

(73) Assignee: The Coca-Cola Company, Atlanta, GA (US)

( * ) Notice: Subject to any disclaimer, the term of this patent is extended or adjusted under 35 U.S.C. 154(b) by 989 days.

(21) Appl. No.: 12/724,477

(22) Filed: Mar. 16, 2010

(65) Prior Publication Data

US 2011/0226793 A1 Sep. 22, 2011

(51) Int. Cl.

| | |
|---|---|
| ***B65D 83/00*** | (2006.01) |
| ***E05B 65/00*** | (2006.01) |
| ***G07F 9/10*** | (2006.01) |
| ***A47F 3/04*** | (2006.01) |
| ***F25B 29/00*** | (2006.01) |
| ***E05B 63/14*** | (2006.01) |
| ***G07F 5/26*** | (2006.01) |
| ***G07F 11/32*** | (2006.01) |

(52) U.S. Cl.

CPC ..... *G07F 9/10* (2013.01); *E05B 63/143* (2013.01); *G07F 5/26* (2013.01); *G07F 11/32* (2013.01); *Y10T 70/50* (2015.04)

(58) Field of Classification Search

USPC ..... 221/133, 154, 263, 265, 266, 268

See application file for complete search history.

(56) References Cited

U.S. PATENT DOCUMENTS

| | | | | |
|---|---|---|---|---|
| 1,841,926 | A | 1/1932 | Wray | |
| 3,110,417 | A | 11/1963 | Wingate et al. | |
| 3,390,754 | A | 7/1968 | Newberry | |
| 3,550,810 | A | 12/1970 | Ambrose | |
| 3,837,528 | A | 9/1974 | Rakucewicz | |
| 4,809,879 | A | 3/1989 | Hanley | |
| 5,385,267 | A | 1/1995 | Diamond et al. | |
| 5,799,823 | A * | 9/1998 | Feltrin | 221/298 |
| 5,967,364 | A | 10/1999 | Swanson et al. | |
| 6,321,936 | B1 | 11/2001 | Feltrin | |
| 6,409,045 | B1 * | 6/2002 | Lauer | 221/124 |
| 6,415,953 | B1 | 7/2002 | O'Brien et al. | |
| 6,513,677 | B1 * | 2/2003 | Sorensen et al. | 221/130 |
| 7,513,390 | B2 | 4/2009 | Artsiely | |

(Continued)

FOREIGN PATENT DOCUMENTS

| | | |
|---|---|---|
| GB | 1220295 | 1/1971 |
| JP | 2007286747 | 11/2007 |

OTHER PUBLICATIONS

PCT, Title: International Preliminary Report on Patentability, pp. 1-6.

(Continued)

*Primary Examiner* — Gene Crawford

*Assistant Examiner* — Kelvin L Randall, Jr.

(74) *Attorney, Agent, or Firm* — Eversheds Sutherland (US) LLP

(57) ABSTRACT

The present application provides a vendor for vending a number of products. The vendor may include a cooler and a vending device positioned within the cooler. The vending device may include a number of product shelves with a number of product gates and one or more product locking systems that permit the removal of only one product at a time from the product gates.

34 Claims, 13 Drawing Sheets

(56) References Cited

U.S. PATENT DOCUMENTS

| | | | | |
|---|---|---|---|---|
| 2001/0000609 | A1* | 5/2001 | Rudick et al. | 221/6 |
| 2002/0083747 | A1 | 7/2002 | Beylotte et al. | |
| 2003/0222093 | A1* | 12/2003 | Roekens et al. | 221/123 |
| 2005/0127014 | A1 | 6/2005 | Richter et al. | |
| 2010/0059469 | A1* | 3/2010 | Mason et al. | 211/162 |
| 2011/0301749 | A1 | 12/2011 | Hammonds et al. | |

OTHER PUBLICATIONS

International Search Report and Written Opinion of the International Searching Authority for PCT/US2015/046558, dated Nov. 30, 2015.

* cited by examiner

VENDOR

TECHNICAL FIELD

The present application relates generally to vending machines and mechanisms and more particularly relates to simplified vending mechanisms positioned within a cooler.

BACKGROUND OF THE INVENTION

Traditional vending machines are generally desired to be positioned in locations of moderate to heavy consumer traffic. Locations with less consumer traffic, such as certain offices, hospitals, schools, retail establishments, and the like, may not be well suited for the usual size and expense related to the use of a traditional vending machine. Specifically, the components of the vending machine, such as the vending mechanism, the refrigeration equipment, the payment equipment, the product stocks, and the like, may be relatively expensive to provide and operate. Moreover, the size of the traditional vending machine may result in a slow rotation of product through the vending machine.

Coolers, particularly glass door coolers, may be somewhat less expensive to provide and operate given the lack of at least the vending mechanism. Glass door coolers also generally offer the advantage of allowing the consumer to see the products available within the cooler. Such visibility may provide the opportunity to promote the products therein and also may promote impulse purchases. The lack of the vending mechanism, however, generally means that the removal of products from the cooler cannot always be controlled.

There is thus a desire therefore for improved vending machine. Such a vending machine may offer the positive features of a glass door cooler but with appropriate vending controls. Such an improved vending machine further should be less expensive to provide and operate as compared to a traditional vending machine and the like.

SUMMARY OF THE INVENTION

The present application thus provides a vendor for vending a number of products. The vendor may include a cooler and a vending device positioned within the cooler. The vending device may include a number of product shelves with a number of product gates and one or more product locking systems that permit the removal of only one product at a time from the product gates.

The product locking systems may include one or more mechanical product locking systems. The cooler may include a transparent door cooler. The cooler may include a refrigeration and/or a heating cassette therein. The vendor further may include a payment device positioned about the cooler and in communication with the vending device. The payment device may include a control.

The product shelves may include a number of gravity fed product shelves. The product locking systems may include a product gate system. The product gate system may include a rotatable base in communication with each product gate and a number of pivoting levers maneuverable by the base. The product gate system may include one or more pivoting flaps maneuverable by the levers to permit the removal of only one product at a time from the product gate.

The product locking systems may include a product shelf locking system. The product shelf locking system may include a rotatable cam in communication with each product gate. A cursor may be positioned between each pair of cams such that rotation of one cam moves the cursor to prevent the rotation of the remaining cams.

The product locking systems may include a product shelf locking system in communication with a vertical shelf locking system. The product shelf locking system may include an end cursor on each product shelf and the vertical shelf locking system may include a number of vertical slides that cooperate with the end cursors. The end cursor may include an inclined plane and the vertical slide may include an indent. The vertical slide may include a wing that cooperates with the end cursor. The engagement of one end cursor and the vertical slides prevents the movement of the remaining end cursers and the product shelf locking systems.

The vendor may include a payment locking system in communication with the vertical shelf locking system. The vendor further may include a payment locking system in communication with the number of vertical slides of the vertical shelf locking system. The payment locking system may include a motor driven cam in communication with the vertical slides such that rotation of the cam blocks the movement of the number of vertical slides. The payment locking system may include one or more micro-switches to determine the position of the cam. The payment locking system may include an equalizer in communication with the cam. Each product shelf may include a payment locking system. The product locking systems may include a product shelf locking system with a solenoid and a shutter.

The present application further provides a vendor for vending a number of products. The vendor may include a glass door cooler and a vending device positioned within the cooler. The vending device may include a number of gravity fed product shelves with a number of product gates, a product gate system for blocking the removal of any further products once one product has been removed from a product gate, and a product shelf locking system for locking the remaining product gates once one product gate has been opened.

The vendor further may include a vertical shelf locking system for locking the product gates on other product shelves once one product gate has been opened. The product shelf locking system may include an end cursor on each product shelf and the vertical shelf locking system may include a number of vertical slides that cooperate with the end cursors. The engagement of one end cursor and the vertical slides prevents the movement of the remaining end cursers and the product shelf locking systems. The vendor further may include a payment locking system in communication with the vertical shelf locking system.

The present application further proves a method of vending a number of products. The method may include the steps of providing a number of product shelves with each of the product shelves having a number of product gates with the products there behind and rotating one of the product gates to make a first product accessible for removal. The rotation of the product gate causes rotation of a number of flaps so as to prevent the removal of any further products through the product gate and the rotation of the product gate causes the rotation of a cam so as to lock the remaining product gates on the product shelf. The rotation of the product gate causes a vertical slide to rise and lock the product gates on the remaining product shelves.

The present application further provides a vendor for vending a number of products. The vendor may include a glass door cooler and a vending device positioned within the cooler. A number of product gates may be positioned within the vending device. A product gate system may be in communication with each of the product gates so as to permit the removal of only one product at a time from the number of product gates.

The product gate system may include a rotatable base in communication with each product gate with a number of pivoting levers maneuverable by the base. The product gate system may include one or more pivoting flaps maneuverable by the levers to permit the removal of only one product at a time from the product gate.

The present application further may provide a vendor for vending a number of products. The vendor may include a glass door cooler and a vending device positioned within the cooler. The vending device may include a number of product shelves with a number of product gates, a product shelf locking system, and a vertical shelf locking system in communication with the product shelf locking system to prevent the opening of more than one product gate at a time.

The product shelf locking system may include a rotatable cam in communication with each product gate. A cursor may be positioned between each pair of cams such that rotation of one cam moves the cursor to prevent the rotation of the remaining cams. The product shelf locking system may include an end cursor on each product shelf and the vertical shelf locking system may include a number of vertical slides that cooperate with the end cursors. The engagement of one end cursor and the vertical slides prevents the movement of the remaining end cursers and the product shelf locking systems. The vendor further may include a payment locking system in communication with the vertical shelf locking system. Each product shelf may include a payment locking system.

These and other features and improvements of the present application will become apparent to one of ordinary skill in the art upon review of the following detailed description when taken in conjunction with the several drawings and the appended claims.

DETAILED DESCRIPTION

The present application concerns the vending of any number of products 10. Although the products 10 are shown, by way of example only, in the form of cans 20, it is understood that the products 10 may include any type or size of container including, but not limited to, cans, bottles, pouches, boxes, wrapped items, and/or any type of rigid or flexible packaging. The products 10 may include beverages, food items, non-food items, consumer products, and/or any type of product 10 that may be vended. The scope of the application is in no way limited by the nature of the products 10 intended to be vended herein or otherwise. Similarly, while one use herein is for a chilled product 10, it will be understood that the products 10 herein may be at ambient or elevated temperatures or at any temperature.

Figure 1:
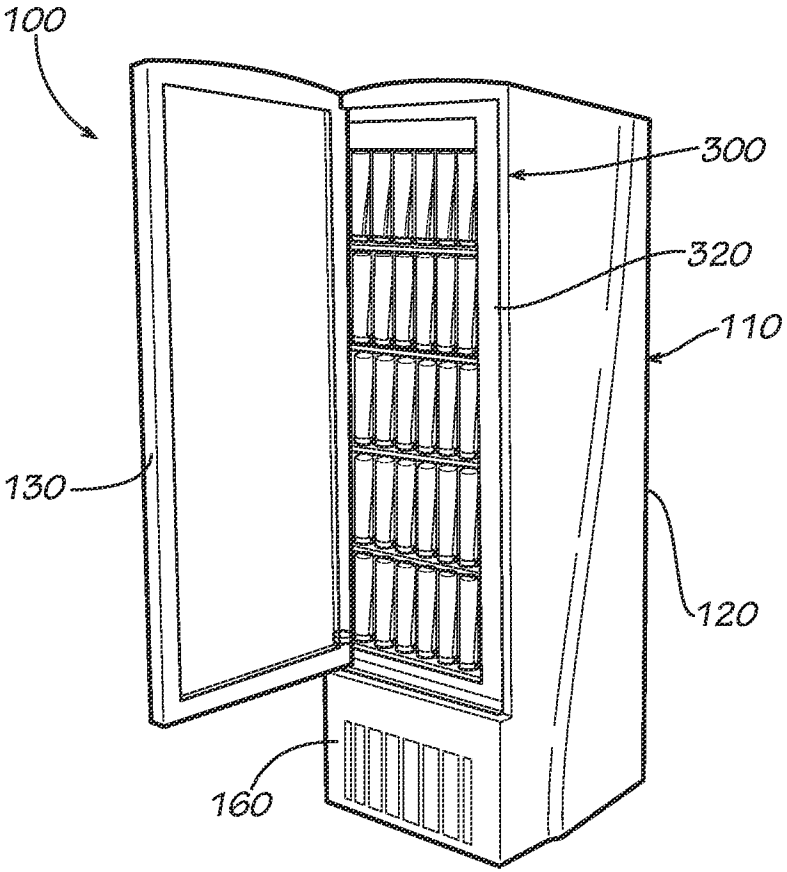
FIG. 1 is a perspective view of a vendor as may be described herein.

Referring now to the drawings, in which like numerals refer to like elements throughout the several views, FIG. 1 shows a vendor 100 as may be described herein. The individual components of the vendor 100 described in detail below may be generally modular in nature. As such, the various components may be original equipment and/or retrofitted as desired. Likewise, not all of the components may be required to operate the vendor 100 as a whole. Rather, many alternative configurations may be used herein. The vendor 100 may be primarily intended for indoor use but may be located anywhere adjacent to an electrical power source and the like.

Figure 2:
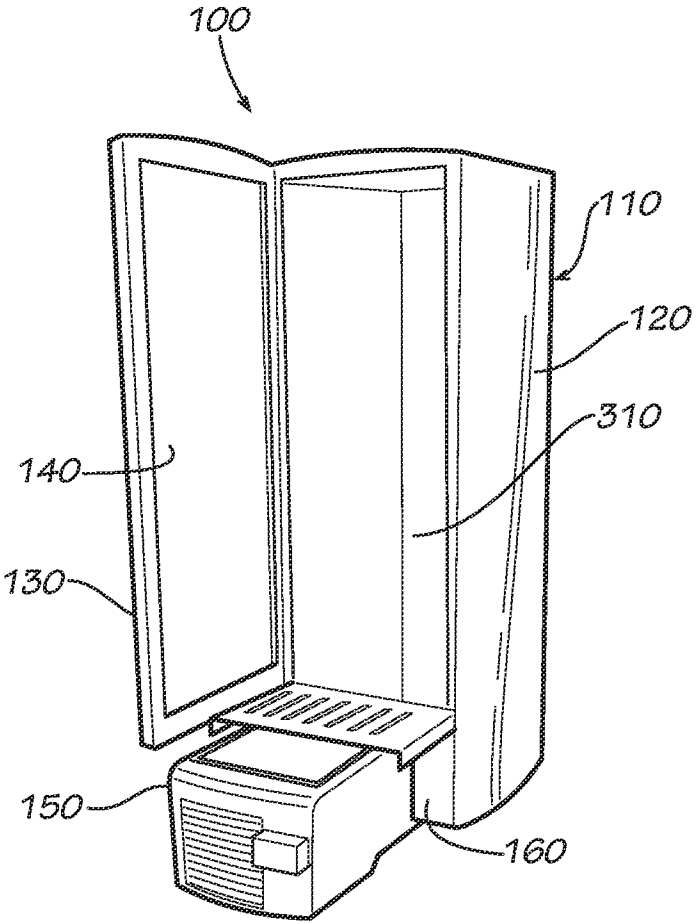
FIG. 2 is a perspective view of a cooler that may be used with the vendor of FIG. 1.

The vendor 100 may include a cooler 110. As is shown in FIG. 2, the cooler 110 may include an outer frame 120 enclosed by a door 130. The frame 120 and the door 130 may be largely of conventional design and may be insulated as desired. The door 130 may include a transparent panel 140 therein. The transparent panel 140 may be made out of glass and the like. The door 130 may swing open and may include a lock or other type of anti-tamper mechanisms thereon. The cooler 110 may have any desired size or shape.

The vendor 100 also may include a refrigeration/heating cassette 150 positioned within the cooler 110. Specifically, the refrigeration/heating cassette 150 may be positioned within a refrigeration/heating compartment 160 of the frame 120 or otherwise. The refrigeration/heating cassette 150 may be modular and may be of conventional design. An example of the refrigeration/heating cassette 150 is shown in commonly owned U.S. Pat. No. 7,117,689, entitled "Removable Refrigeration Cassette for a Hot and Cold Vending Machine" to Rudick, et al. U.S. Pat. No. 7,117,689 is incorporated herein by reference in full. Other types of heating and/or refrigeration devices may be used herein. Refrigeration, heating, and/or both thus may be provided herein.

Figure 3:
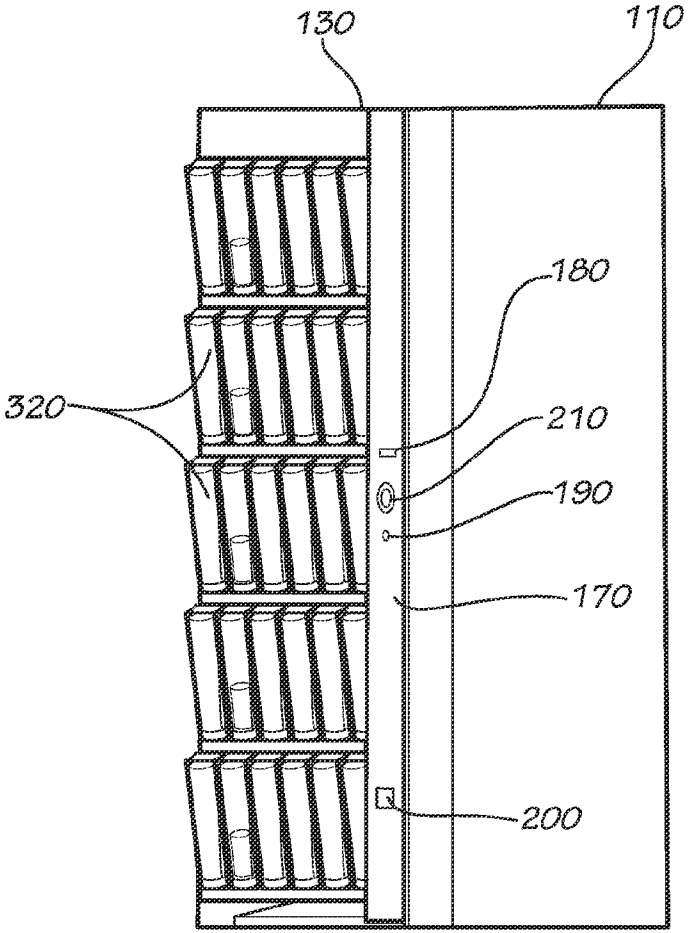
FIG. 3 is a perspective view of the vendor of FIG. 1 with a payment device.

The vendor 100 also may include a payment device 170. The components of the payment device 170 may be positioned about the frame 120 and the door 130 of the cooler 110. Specifically as is shown in FIG. 3, the door 130 may include a money slot 180, a money return button 190, and a money return holder 200. A status display panel 210 also may be positioned on the door 130. These and other components of the payment device 170 positioned on the door 130 in turn may cooperate with the components positioned within the frame 120.

Figure 4:
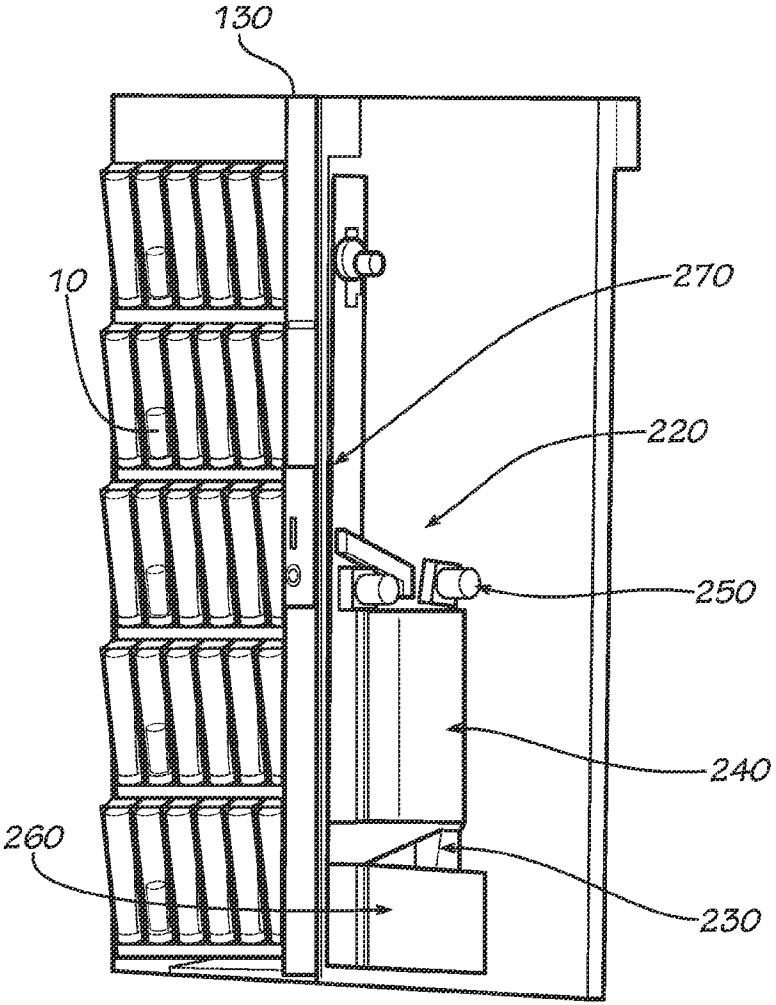
FIG. 4 is perspective view of the vendor of FIG. 1 showing the payment device with a side frame door open.

As shown in FIG. 4, these components may include a money channel 220 in communication with the money slot 180 and a money return channel 230 in communication with the money return holder 200. Also positioned about the frame 120 may be a payment system 240, a money return unit 250, and a money box 260. The components of the payment device 170 may be controlled by an electronic control 270. The electronic control 270 may be a conventional programmable microprocessor and the like. The electronic control 270 also may communicate with other components of the overall vendor 100 as will be described in more detail below. The payment device 170 also may include other or different components and other or different configurations.

The vendor 100 further may include a vending device 300. The vending device 300 may be positioned within a vending compartment 310 of the cooler 100. The vending device 300 and the vending compartment 310 may be in communication with the refrigeration/heating cassette 150 positioned within the refrigeration/heating compartment 160. The vending device 300 may have any size or shape. Other configurations may be used herein.

Figure 5:
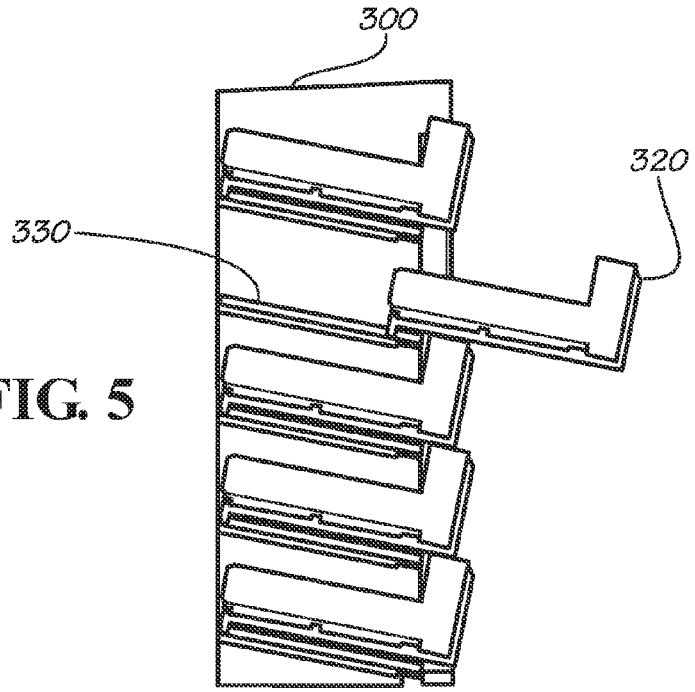
FIG. 5 is a side perspective view of a number of product shelves of the vending device that may be used with the vendor of FIG. 1.

As is shown in FIGS. 1 and 5, the vending device 300 may include a number of product shelves 320. The product shelves 320 may be positioned on a pair of fixed guides 330 or otherwise. The product shelves 320 may be slidable within the fixed guide 330 so as to provide for easy first in, first out loading for the products 10 and also to remove the product shelves 320 themselves. One or more of the product shelves 320 may be positioned at an angle from back to front so as to promote self feeding of the products 10 therein via gravity. Other types of shelf configurations may be used herein.

Figure 6:
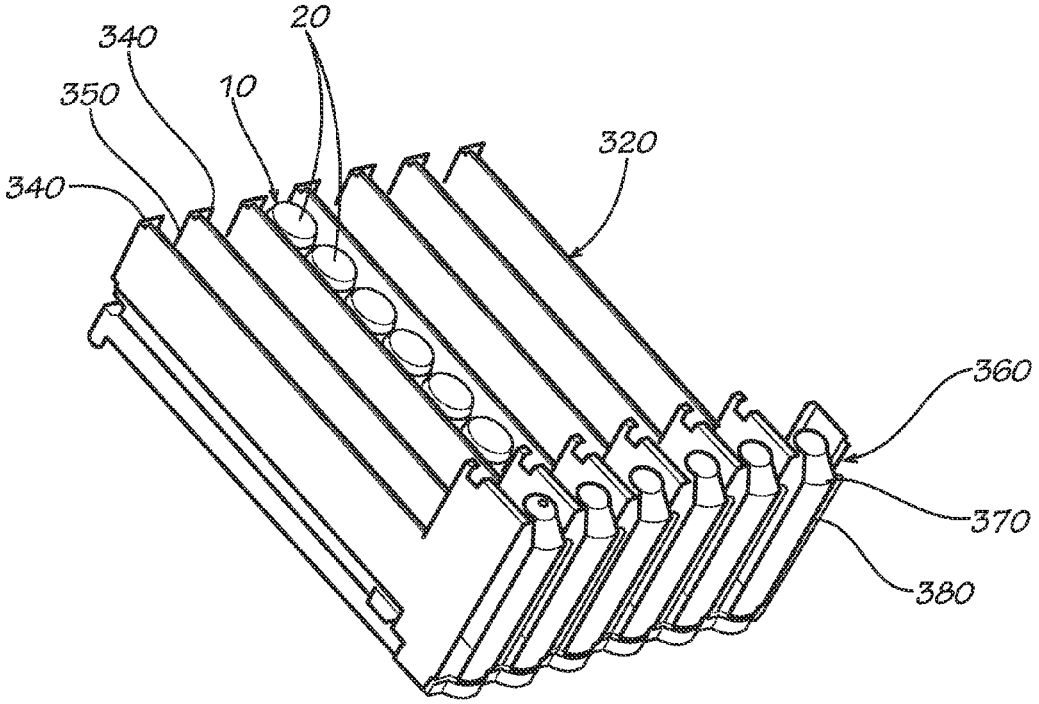
FIG. 6 is a perspective view of a product shelf.

FIG. 6 shows one of the product shelves 320. Each product shelf 320 may have a number of lateral walls 340 that define a number of product rows 350. Any number of product rows 350 may be used. Likewise, the product rows 350 may have any dimension. Different sizes and shapes of product rows 350 also may be used together. As is shown, a number of the products 10 may be positioned within each of the product row 350.

The lower end of each product row 350 may include a product gate system 360. The product gate system 360 ensures that only one product 10 is removed from the product shelf 320 during each vend. Each of the product gate systems 360 includes a product gate 370. The product gate 370 preferably may be made from a transparent material such that the products 10 therein may be visible in whole or in part. The product gate 370 may have a somewhat convex shape and may extent for about the length of the product 10 intended to be positioned therein. Other shapes and sizes may be used herein. Each product gate 370 includes a largely vertically extending door 380 positioned on a pivoting base 390. The pivoting base 390 may be attached to the end of the product row 350. Although the base 390 is shown as largely circular in shape, any size or shape may be used herein.

Figure 8:
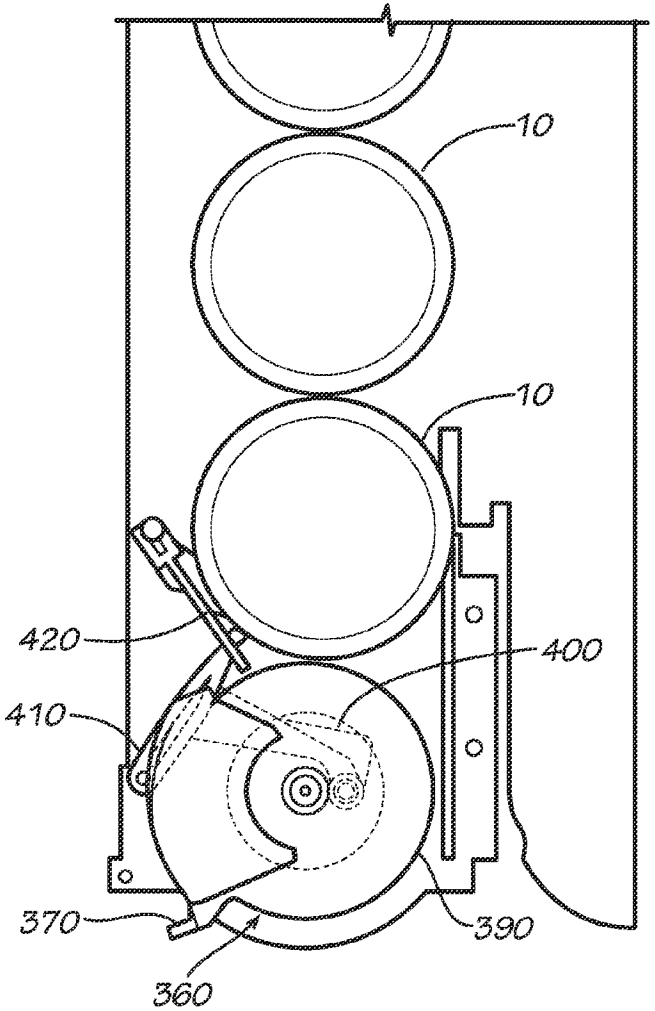
FIG. 8 is a top plan view of the product gate system in a blocked position.
Figure 7:
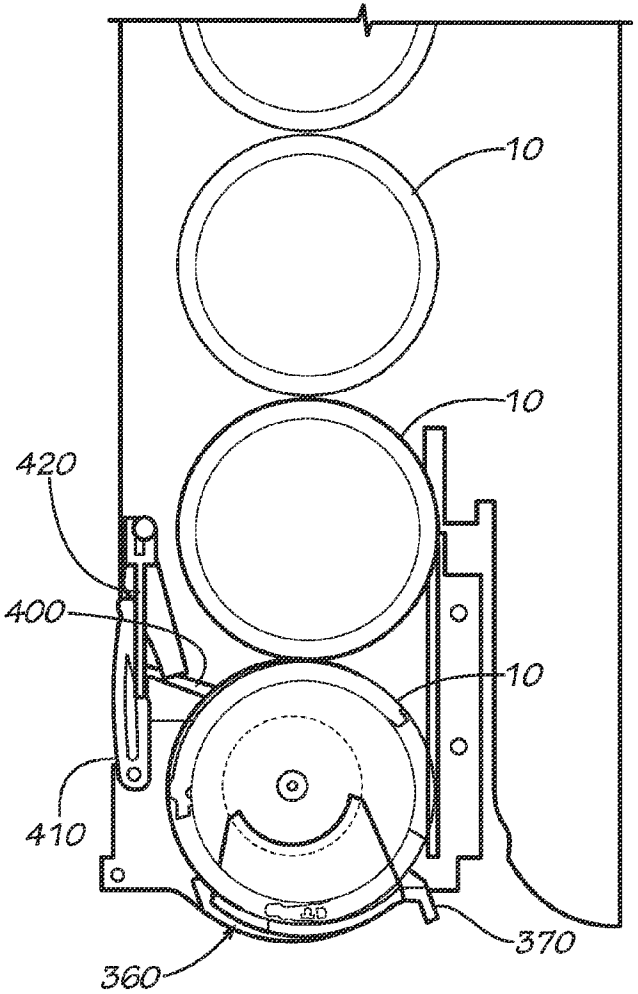
FIG. 7 is a top plan view of a product gate system in a closed position.

As is shown in FIGS. 7 and 8, the product gate system 360 also may include a number of levers, a first lever 400 and a second lever 410. The first lever 400 may be attached to the base 390 and pivots therewith so as to pull the second lever 410 along as the base 390 rotates. The second lever 410 in turn pulls a flap 420. The second flap 420 serves to block the following product 10 once the first product in the product row 350 is removed from the base 390. Specifically, the levers 400, 410 rotate the flap 420 into contact with the next product 10 once the product gate 370 is rotated open. The terms "lever" and "flap" simply refer to any type of extended member and may have any size of shape. Other configurations may be used herein.

Figure 10:
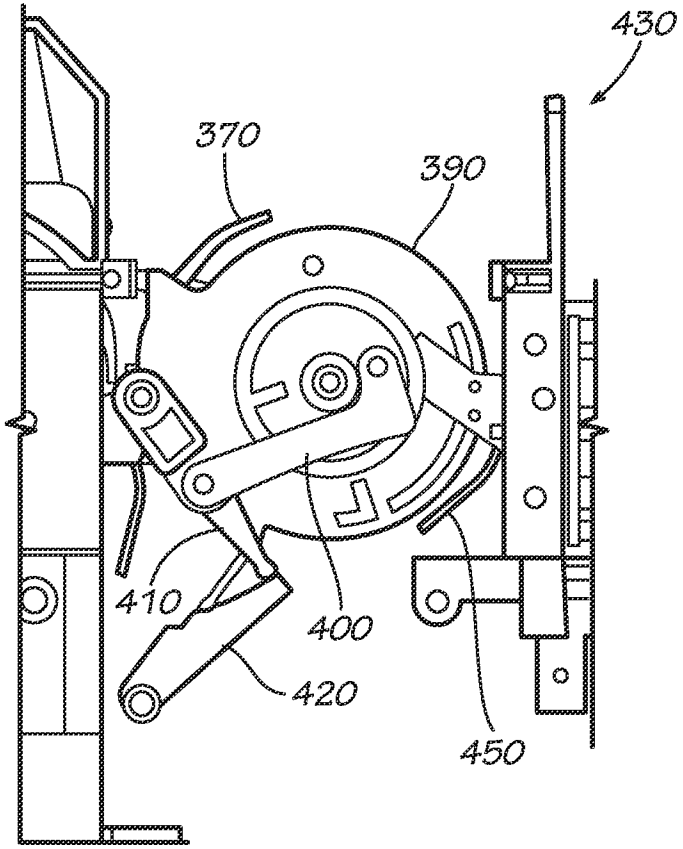
FIG. 10 is a top plan view of the alternative product gate system in a blocked position.
Figure 9:
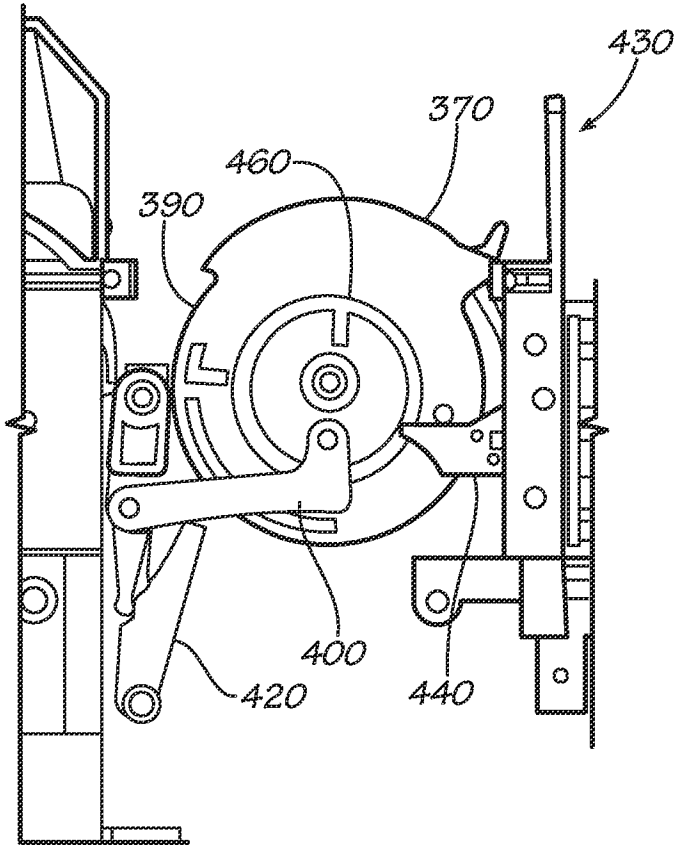
FIG. 9 is an alternative embodiment of a product gate system in a closed position.

FIGS. 9 and 10 show a further embodiment of a product gate system 430. The system 430 also uses the first lever 400, the second lever 410, and the flap 420. This system 430 also uses a third lever 440 attached to a second flap 450. One end of the third lever 440 rides along a circular rib 460 positioned on the base 390. Rotation of the base 390 pivots the third lever 440 and the accompanying second flap 450 so as to provide a further barrier to the next product 10 in the row 350. Other configurations may be used herein.

Figure 11:
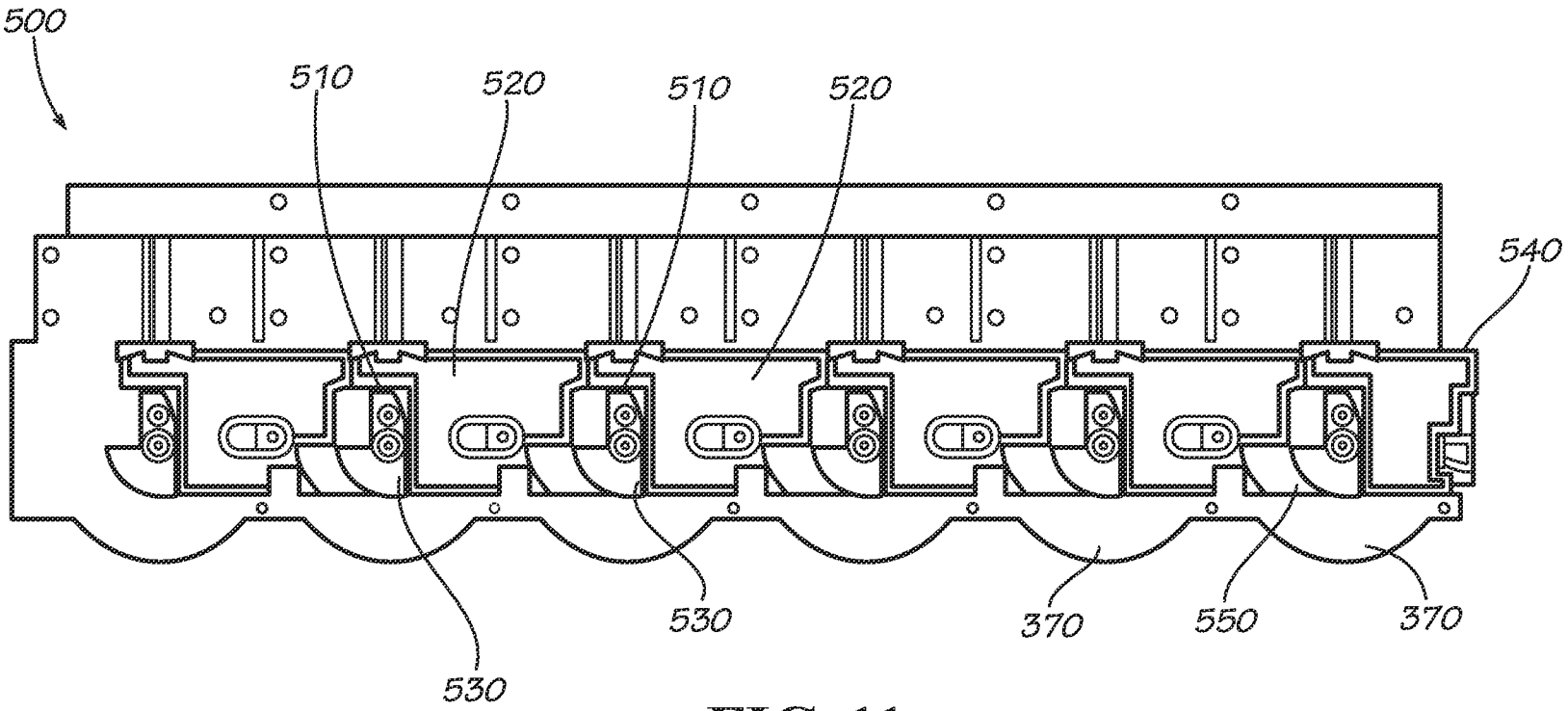
FIG. 11 is a top plan view of the product gate locking system in a closed position.

As is shown in FIG. 11, the vending device 300 of the vendor 100 also may include a product shelf locking system 500 associated with the product gate systems 360. The product shelf locking system 500 prevents the remaining product gates 370 on a given product shelf 320 from opening once any one product gate 370 on the product shelf 320 is opened.

Figure 12:
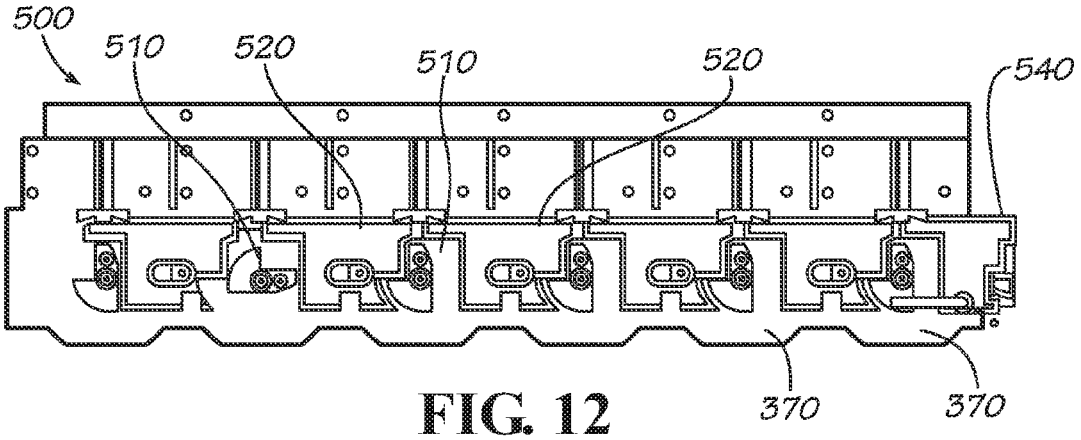
FIG. 12 is a top plan view of the product gate locking system with one product gate open.
Figure 13:
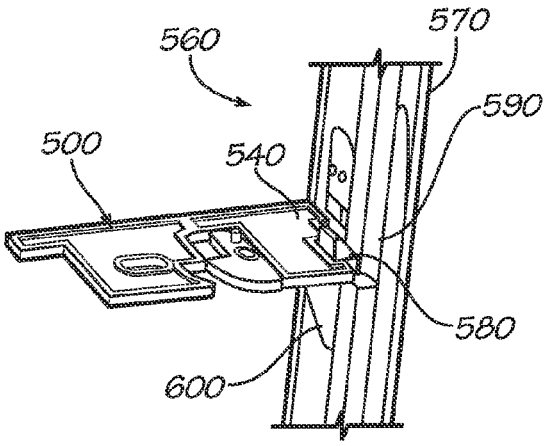
FIG. 13 is a perspective view of a vertical shelf locking system.

The product shelf locking system 500 may include a number of cams 510. The cams 510 may be attached to the base 390 of each product gate system 360 for rotation therewith. The product shelf locking system 500 also may include a number of cursors 520 or other type of movable position marker positioned about each set of cams 510. The cams 510 and the cursors 520 may have any desired size or shape. A cam spring 530 also may be attached to each cam 510 to return the cam 510 to its original position. The product shelf locking system 500 also may include an end cursor 540 positioned on one end thereof and having a cursor spring 550 attached to the adjacent cam 510. Rotation of any one of the product gates 570 also causes the related cam 510 to rotate as is shown in FIG. 12. This rotation pushes the remaining cursors 520 to the right such that their related cams 510 are blocked from rotation. This blocking thus prevents the remaining product gates 370 from rotating. As such, once one product gate 370 on a given product shelf 320 is rotated, then the remaining product gates 370 are locked. Other configurations may be used herein.

As is shown in FIGS. 13-16, the vending device 300 of the vendor 100 also may include a vertical shelf locking system 560. The vertical shelf locking system 560 may cooperate with the product shelf locking system 500 and, as such, the product gate system 360. Specifically, the vertical shelf locking system 560 engages each of the remaining product shelf locking systems 360 once any one product gate 370 is opened on any product shelf 320.

The vertical shelf locking system 560 may include a number of vertical slides 570. The vertical slides 570 may extend on one side of the product shelves 320. The vertical slides 570 may cooperate with the end cursor 540 of each product shelf 320. Specifically, the vertical slides 570 may cooperate with an inclined plane 580 positioned on each of the end cursors 540. The vertical slides 570 may have a similarly sized indent 590 that may cooperate therewith. Positioned about each of the indents 590 on the vertical slides 570 also may be a wing 600. Other types of engagement means may be used herein.

Figure 14:
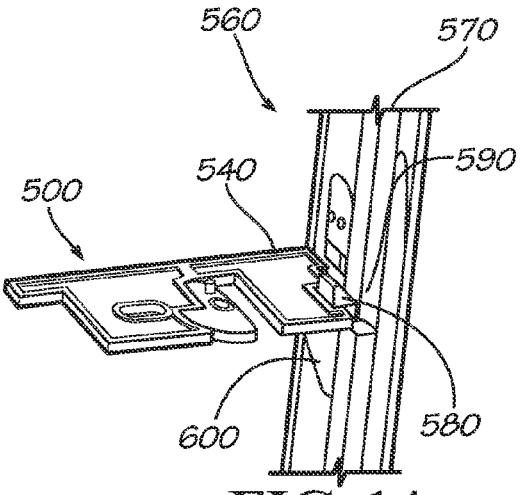
FIG. 14 is a perspective view of the vertical shelf locking system in an engaged position.
Figure 15:
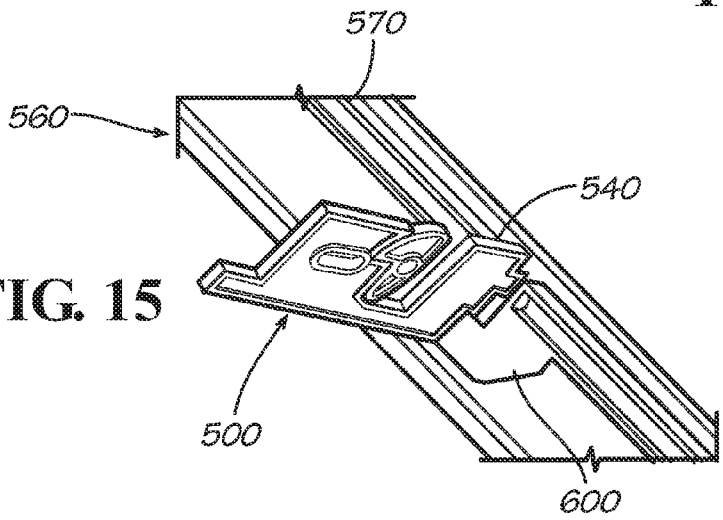
FIG. 15 is a bottom perspective view of the vertical shelf locking system in the engaged position.

When the end cursor 540 is forced to the right as in FIG. 14 (or to the left as the case may be) by the product shelf locking system 500 due to the opening of a product gate 570, the inclined plane 580 of the end cursor 540 pushes the vertical slide 570 upward via the indent 590. By pushing the end cursor 540 into the indent 590, the vertical slides 570 underneath the particular product shelf 320 are prevented from upward movement as is shown in FIG. 15. Specifically, the product gates 370 on the product shelves 320 beneath the given product shelf 320 can only rotate if the end cursor 540 of the product locking system 500 is free to move to the right and raise the related vertical slide 570. Instead, the movement of one end curser blocks the movement of the vertical slides 570 below.

Figure 16:
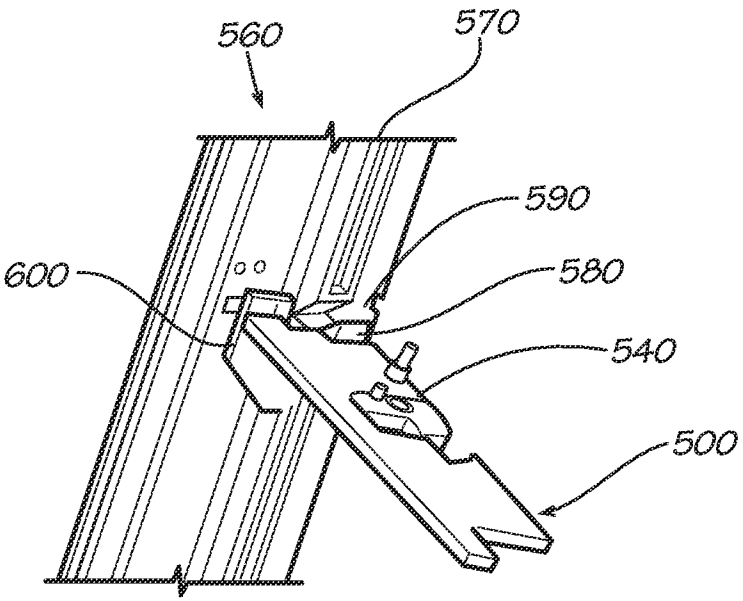
FIG. 16 is a perspective view of an upper shelf engaged with the vertical shelf locking system.

Similarly, the upward motion of the vertical slide 570 above the given product shelf 320 positions the wing 600 into contact with the end cursor 540 of the product shelf 320 above the given product shelf 320 as is shown in FIG. 16. This positioning of the wing 600 thus also preventing motion of the end cursors 540 above the given product shelf. As such, the opening of any one product gate 370 thus prevents any other product gate 370 in the vending device 300 from opening.

Figure 17:
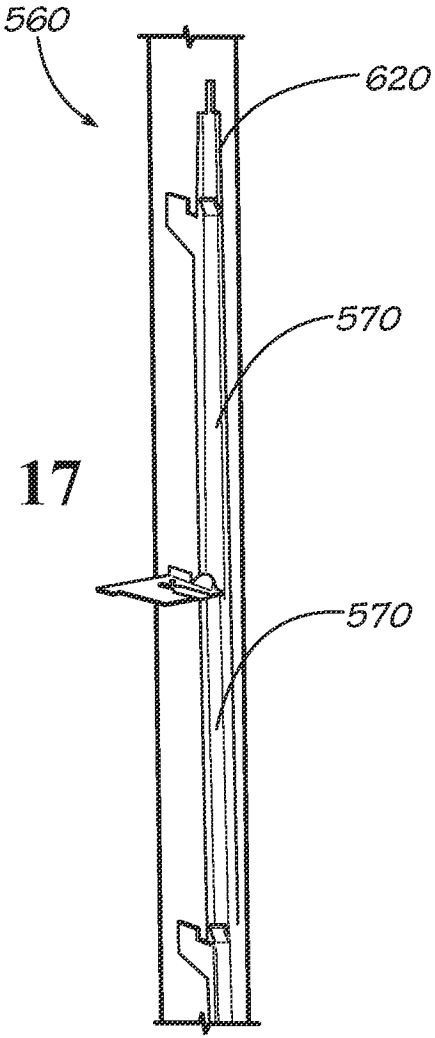
FIG. 17 is a perspective view of the vertical shelf locking system with an end slide thereon.

The vertical shelf locking system 560 also may be used with a payment locking system 610. Specifically, FIG. 17 shows a number of vertical slides 570. Although only portions of three (3) vertical slides 570 are shown, any number of vertical slides 570 may be used. As described above, the products 10 may be removed from the vending device 300 only when the vertical slides 570 have freedom to move in the vertical direction. Once one of the end cursors 540 engages the associated vertical slide 570, no other products 10 may be removed. The vertical shelf locking system 560 thus also may be used with respect to payment. As is shown, an end slide 620 may be positioned on top of the last vertical slide 570. Other configurations may be used herein.

Figure 18:
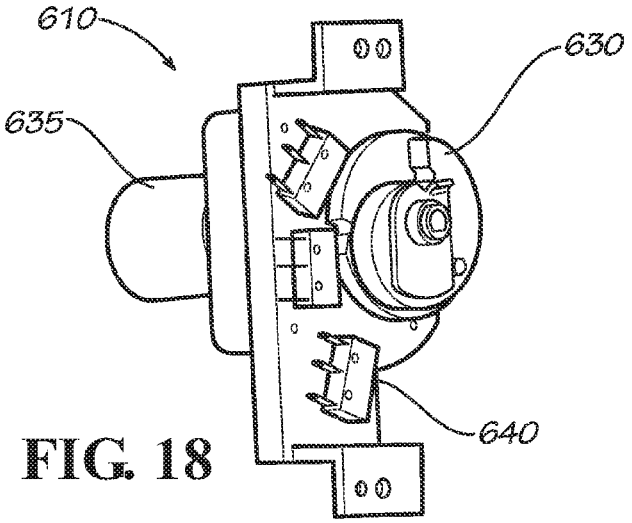
FIG. 18 is a perspective view of a payment locking system.
Figure 19:
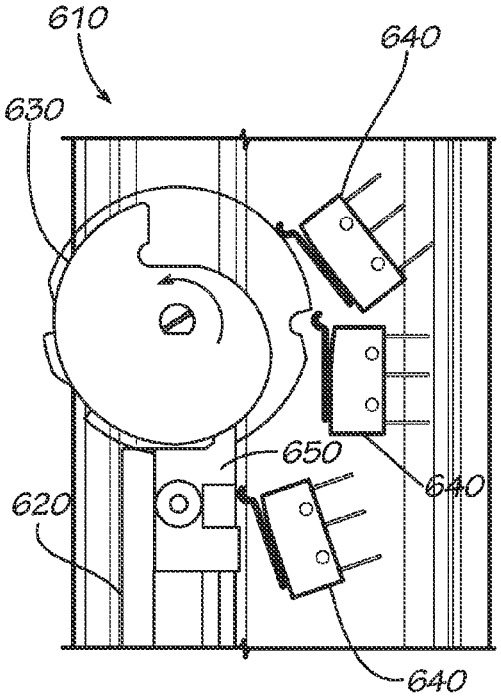
FIG. 19 is a top plan view of the payment locking system in a blocked position

As is shown in FIG. 18, the payment locking system 610 may include a cam 630 or a similar structure driven by a motor reducer 635 or other type of drive means. The motor reducer 635 may be in communication with the control 270 associated with the payment device 170 or otherwise. The payment locking system 610 further may include a number of micro-switches 640 positioned about the cam 630. An actuator 650 may be positioned on the end slide 620 of the vertical slides 570 and may cooperate with the cam 630. FIG. 19 shows the payment locking system 610 in a blocked state. Specifically, the cam 630 prevents the vertical movement of the actuator 650 on the end slide 620 of the vertical slides 570. As is described above, the product gates 370 are inoperative when the vertical slides 570 are immobile.

Figure 20:
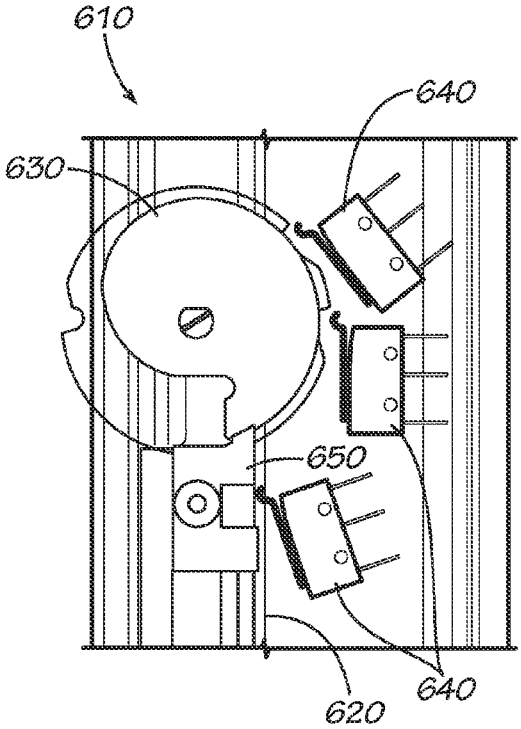
FIG. 20 is a top plan view of the payment locking system in a released position.
Figure 21:
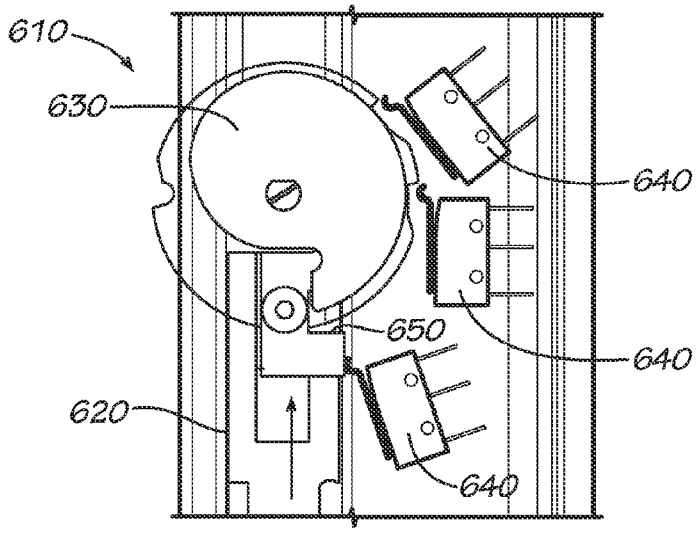
FIG. 21 is a top plan view of the payment locking system in an engaged position.

Upon instruction from the control 270 or otherwise, the cam 630 may be rotated into a released position as is shown in FIG. 20 so as to allow for movement of the vertical slides 570 and, hence, the opening of a product gate 370. The micro-switches 640 detect the upward movement of the actuator 650 as in FIG. 21 so as to indicate that a product 10 is being vended. Opening further product gates 370 is thus prevented by the product shelf locking system 500 and the vertical shelf locking systems 560 described above. Once the product 10 is removed from the product gate 370, the cam spring 530 and the cursor spring 560 close the product gates 370, the related cam 510, and the related end cursor 540. The vertical slides 570 thus are no longer engaged such that the end slide 620 and the actuator 650 will fall by gravity out of engagement with the cam 630. This movement is detected by the micro-switches 640 such that the cam 630 again returns to the blocked position.

Figure 22:
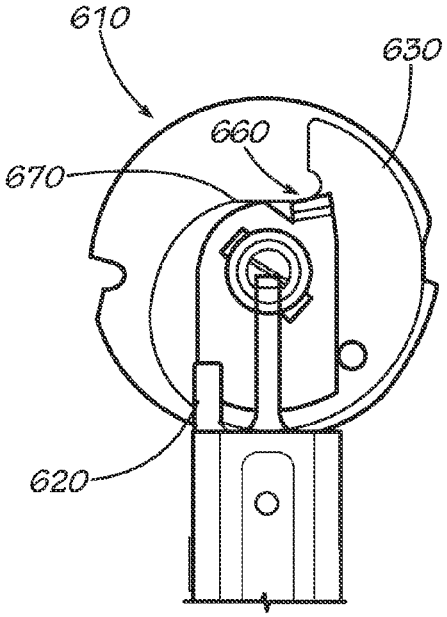
FIG. 22 is a side plan view of a payment locking system with a power loss prevention system in a blocked position.
Figure 23:
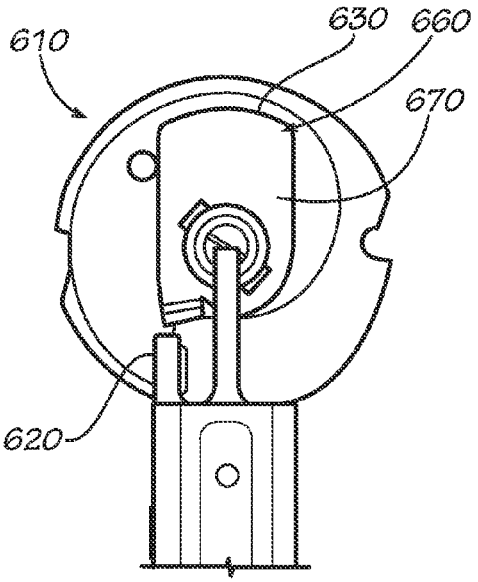
FIG. 23 is a side plan view of the payment locking system with the power loss prevention system in a released position.

The payment locking system 610 also may include a power loss prevention system 660. As is described above, once a vend is complete, the movement of the actuator 650 is detected by the micro-switches 640. The micro-switches 640 then instruct the cam 630 to return to the blocked positioned via the motor reducer 635 or other types of electrical drive means. If the electrical system fails (or if power to the vendor 100 is disengaged) once the actuator 650 is disengaged from the cam 630, but before the cam 630 is driven back to the blocked position, removal of further products 10 may be possible. The power loss prevention system 660 thus includes an equalizer 670 that is coaxial with the cam 630. As is shown in FIGS. 22 and 23, the cam 630 may drag the equalizer 670 during rotation via a pin 680 positioned thereon or otherwise.

Figure 24:
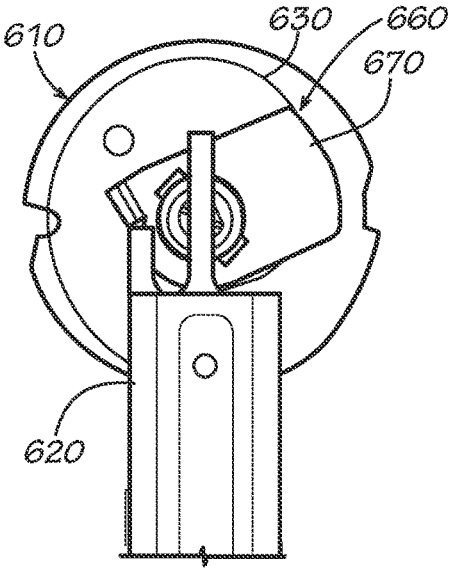
FIG. 24 is a side plan view of the payment locking system with the power loss prevention system in an engaged position.
Figure 25:
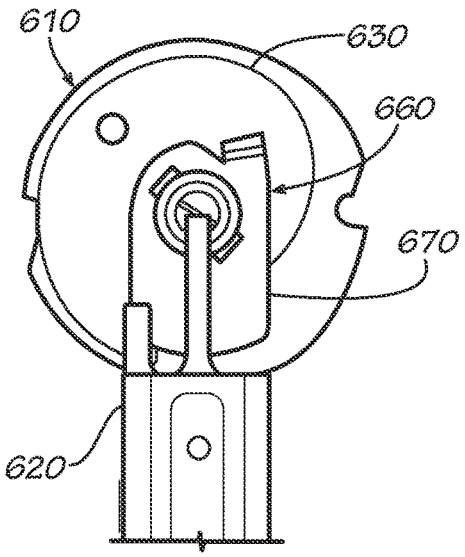
FIG. 25 is a side plan view of the payment locking system with the power loss prevention system in a released position.

As is shown in FIG. 24, when the actuator 650 engages the cam 630 during a vend, the actuator 650 also engages the equalizer 670 so as to cause further rotation under the force of gravity. Once the actuator 650 is engaged following a vend, the equalizer 670 thus continues to rotate into a blocking position as is shown in FIG. 25. The equalizer 670 thus prevents further movement of the actuator 650 even in the absence of electrical power. Once electrical power is reestablished, the cam 630 may be driven back to the blocked position by the motor reducer 635. Other configurations may be used herein.

Figure 26:
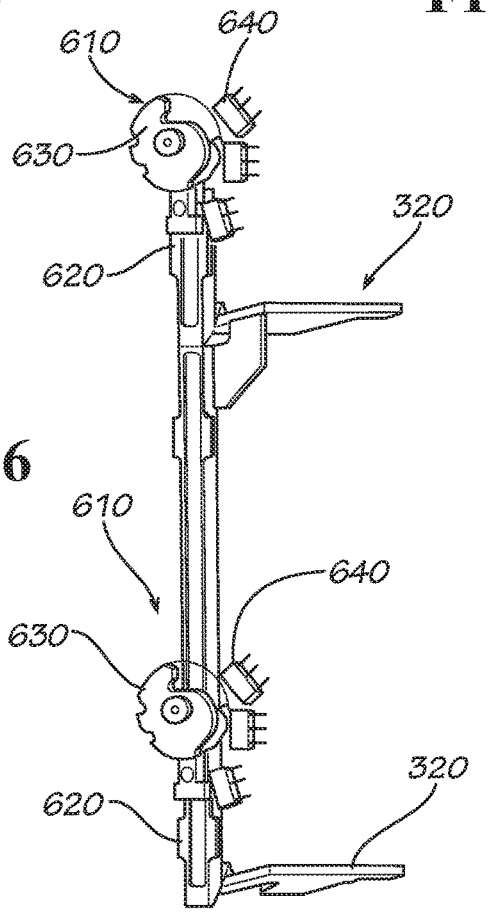
FIG. 26 is a perspective view of multiple payment locking systems.
Figure 27:
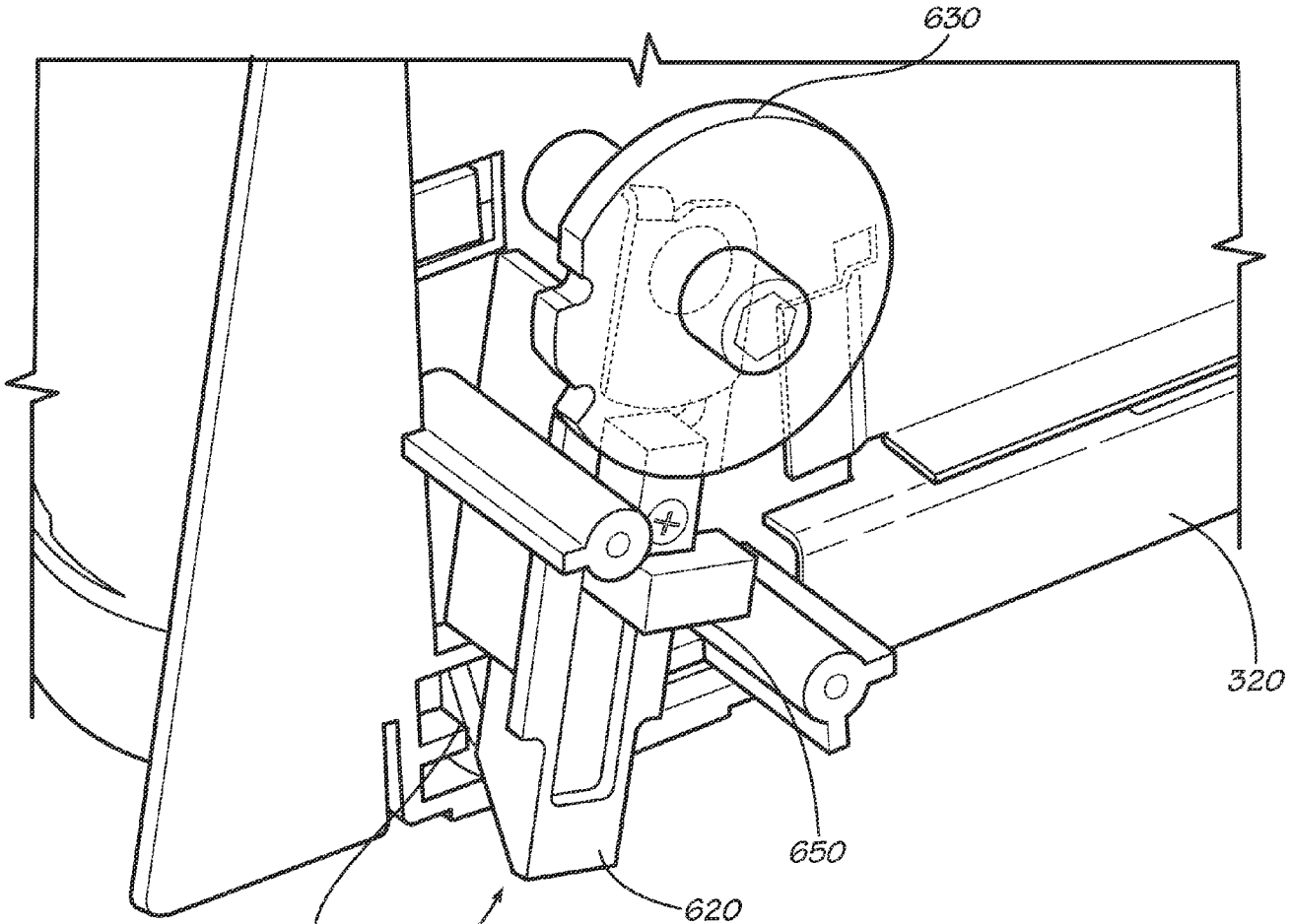
FIG. 27 is a perspective view of an alternative embodiment of a payment locking system.

The payment locking system 610 also may allow for each product shelf 320 to have a different vending price. As is shown in FIG. 26, a payment locking system 610 may be positioned about each product shelf 320. As such, the control 270 or otherwise may individually operate each cam 630 and shelf 320. Once credit equal to any vending established price has been provided, the cams 630 may be placed in the released position. Once a product 10 has been removed from any product gate 370, the micro-switches 640 may indicate that a vend has occurred and all of the cams 630 may be return to the blocked position. Other configurations may be used herein.

FIG. 25 shows a further embodiment of a payment locking system 700. This version of the payment locking system 700 allows each product shelf 320 to have a separate price. Specifically, each product shelf 320 may include the product gate system 360 and the product shelf locking system 500. In this embodiment, the vending device 300 lacks the vertical shelf locking system 560. Rather, each end cursor 540 is in direct contact with only the end slide 620 as opposed to the use of the vertical slides 670. The end slide 620 and the actuator 650 are in communication with the cam 630 as is described above. The control 270 thus may set a vend price for each product shelf 320. Other configurations may be used herein.

Figure 28:
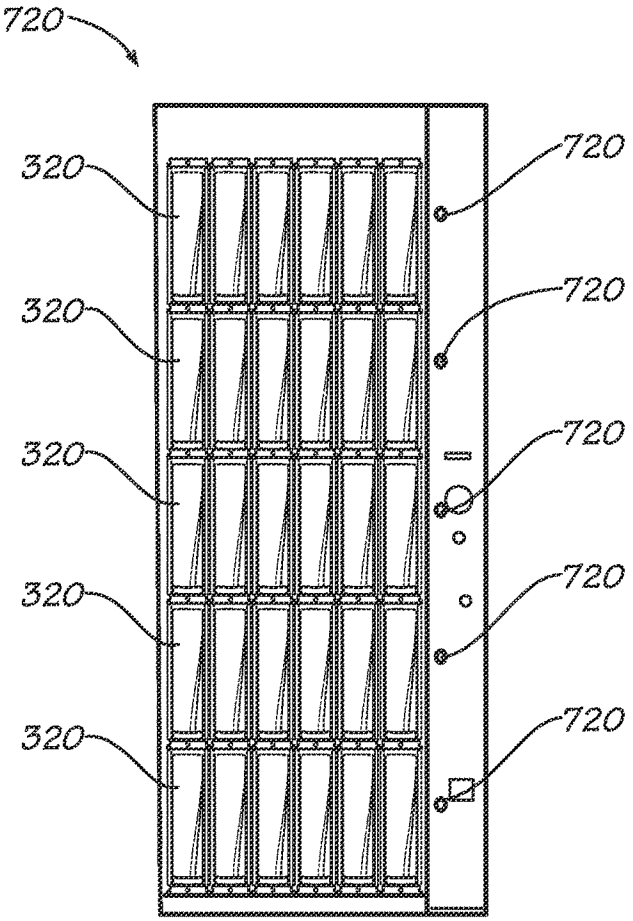
FIG. 28 is a side plan view of an alternative embodiment of the vendor with the payment locking system.

A version of a vendor 710 with the payment locking system 700 is shown in FIG. 28. In this example, a selection button 720 will be positioned about the frame 120 for each product shelf 320. When credit has been established equal to the selected price for that product shelf 320, the selection button 720 will flash so as to indicate that the products 10 therein are available. Pushing one of the selection buttons 720 will keep that button 720 lit while the others will be turned off. The lighted selection button 720 thus indicates that the consumer may select a product 10 from that particular product shelf 320. The selection button 720 or other types of shelf illumination thus may show the available product shelves 320 for the money inserted and also act as an invitation to take a product 10 from the selected shelf 320.

Figure 29:
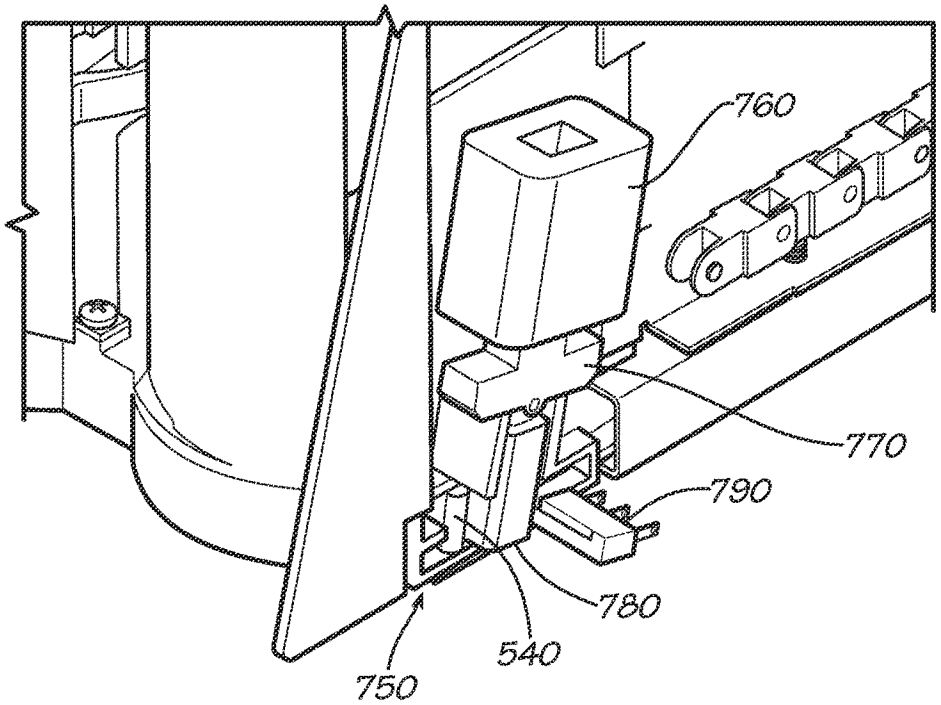
FIG. 29 is a perspective view of a further embodiment of the payment locking system.

FIG. 29 shows a further embodiment of a product locking system 750. Instead of the use of the cam 630 and the actuator 650, the product locking system 650 may include a solenoid 760 with the related T-bar 770. The T-bar 770 may carry a shutter 780 for movement therewith. A micro-switch 790 may be positioned about the shutter 780. The shutter 780 may cooperate with the end cursor 540 of a given product shelf 320. Once a particular product shelf 320 is selected by one of the selection buttons 720, the solenoid 760 may be energized and attract the T-bar 770. This movement also raises the shutter 780 so as to allow movement of the end cursor 540. When one of the product gates 370 is opened, the end cursor 540 moves to the right and actuates the micro-switch 790. This contact indicates that a vend has occurred.

The solenoid 760 then may be de-energized such that the T-bar 770 and the shutter 780 may fall on the end cursor 540. Once the vend is complete, the cursor spring 550 again moves the end cursor 540 to the left so as to allow the T-bar 770 and the shutter 780 to fall further under the force of gravity into the blocking position. The shutter 780 thus also functions to prevent misuse in a manner similar to the equalizer 670 described above. Other configurations may be used herein.

It should be apparent that the foregoing relates only to certain embodiments of the present application and that numerous changes and modifications may be made herein by one of ordinary skill in the art without departing from the general spirit and scope of the invention as defined by the following claims and the equivalents thereof.

We claim:

1. A vendor for vending a plurality of products, the vendor comprising:
- a cooler; and
- a vending device positioned within the cooler, the vending device comprising:
  - a plurality of product shelves, each of the product shelves comprising:
    - a plurality of product rows, each of the product rows configured to contain a plurality of products therein; and
    - a product gate positioned about each of the product rows and comprising a base with a substantially vertical door extending therefrom configured to partially rotate about a substantially vertical axis from a closed position preventing access to the products in the respective product row to an open position allowing access to one of the products in the respective product row; and
  - one or more product locking systems configured to allow partial rotation of one of the product gates to the open position while restricting rotation of a remainder of the product gates, the one or more product locking systems comprising a product shelf locking system positioned about each of the product shelves and configured to allow partial rotation of one of the product gates of the respective product shelf from the closed position to the open position while restricting rotation of a remainder of the product gates of the respective product shelf, each of the product shelf locking systems comprising:
    - a rotatable cam attached to each of the product gates of the respective product shelf and configured to rotate therewith from a first position to a second position; and
    - a cursor positioned between each pair of adjacent cams and configured to translate from a first position to a second position upon rotation of one of the cams from the first position to the second position, the cursors configured to restrict rotation of a remainder of the cams when the cursors are in the second position.

2. The vendor of claim 1, wherein the one or more product locking systems comprise one or more mechanical product locking systems.

3. The vendor of claim 1, wherein the cooler comprises a transparent door.

4. The vendor of claim 1, further comprising a refrigeration cassette or a heating cassette positioned within the cooler.

5. The vendor of claim 1, further comprising a payment device positioned about the cooler and in communication with the vending device.

6. The vendor of claim 5, wherein the payment device comprises an electronic control.

7. The vendor of claim 1, wherein the product shelves comprise gravity-fed product shelves positioned at an angle configured to promote feeding of the products in the product rows via gravity.

8. The vendor of claim 1, wherein the one or more product locking systems comprise a product gate system positioned about each of the product gates and configured to prevent access to a remainder of the products in the respective product row when the product gate is in the open position.

9. The vendor of claim 8, wherein each of the product gate systems comprises a plurality of pivoting levers configured to pivot from a first position to a second position upon partial rotation of the respective product gate from the closed position to the open position.

10. The vendor of claim 9, wherein each of the product gate systems further comprises one or more pivoting flaps configured to pivot from a first position to a second position upon pivoting of the levers from the first position to the second position, and wherein the flaps are configured to prevent access to the remainder of the products in the respective product row when the flaps are in the second position.

11. The vendor of claim 1, wherein the one or more product locking systems comprise a vertical shelf locking system in communication with the product shelf locking systems and configured to cooperate with the product shelf locking systems to allow partial rotation of one of the product gates of one of the product shelves while restricting rotation of the product gates of a remainder of the product shelves.

12. The vendor of claim 11, wherein each of the product shelf locking systems comprises an end cursor positioned about the respective product shelf and configured to translate from a first position to a second position, and wherein the vertical shelf locking system comprises a vertical slide positioned about each of the product shelves and configured to cooperate with the respective end cursor.

13. The vendor of claim 12, wherein each of the end cursors comprises an inclined plane, and wherein each of the vertical slides comprises an indent configured to cooperate with the inclined plane of the respective end cursor.

14. The vendor of claim 12, wherein each of the vertical slides comprises a wing configured to cooperate with the respective end cursor.

15. The vendor of claim 12, wherein the vertical slides are configured to allow translation of one of the end cursors of one of the product shelf locking systems from the first position to the second position while restricting translation of the end cursors of a remainder of the product shelf locking systems.

16. The vendor of claim 11, wherein the one or more product locking systems further comprises a payment locking system in communication with the vertical shelf locking system.

17. The vendor of claim 12, wherein the one or more product locking systems further comprises a payment locking system in communication with the vertical slides of the vertical shelf locking system.

18. The vendor of claim 17, wherein the payment locking system comprises a motor driven cam in communication with the vertical slides and configured to rotate from a first position to a second position, and wherein the cam is configured to restrict movement of the vertical slides when the cam is in the first position.

19. The vendor of claim 18, wherein the payment locking system further comprises one or more micro-switches configured to determine a rotational position of the cam.

20. The vendor of claim 18, wherein the payment locking system further comprises an equalizer in communication with the cam.

21. The vendor of claim 1, wherein the one or more product locking systems comprises a payment locking system positioned about each of the product shelves.

22. A vendor for vending a plurality of products, the vendor comprising:

a glass door cooler; and a vending device positioned within the cooler, the vending device comprising:

a plurality of gravity fed product shelves, each of the product shelves comprising:

a plurality of product rows, each of the product rows configured to contain a plurality of products therein; and a product gate positioned about each of the product rows and comprising a base with a substantially vertical door extending therefrom configured to partially rotate about a substantially vertical axis from a closed position preventing access to the products in the respective product row to an open position allowing access to one of the products in the respective product row;

a product gate system positioned about each of the product gates and configured to prevent access to a remainder of the products in the respective product row when the product gate is in the open position;

a product shelf locking system positioned about each of the product shelves and configured to allow partial rotation of one of the product gates of the respective product shelf from the closed position to the open position while restricting rotation of a remainder of the product gates of the respective product shelf, each of the product shelf locking systems comprising an end cursor positioned about the respective product shelf and configured to translate from a first position to a second position; and a vertical shelf locking system in communication with the product shelf locking systems and configured to cooperate with the product shelf locking systems to allow partial rotation of one of the product gates of one of the product shelves while restricting rotation of the product gates of a remainder of the product shelves, the vertical shelf locking system comprising a vertical slide positioned about each of the product shelves and configured to cooperate with the respective end cursor.

23. The vendor of claim 22, wherein the vertical slides are configured to allow translation of one of the end cursors of one of the product shelf locking systems from the first position to the second position while restricting translation of the end cursors of a remainder of the product shelf locking systems.

24. The vendor of claim 22, wherein the vending device further comprises a payment locking system in communication with the vertical shelf locking system.

25. A vendor for vending a plurality of products, the vendor comprising:

a glass door cooler; and a vending device positioned within the cooler, the vending device comprising:

a plurality of product shelves, each of the product shelves comprising:

a plurality of product rows, each of the product rows configured to contain a plurality of products therein; and a product gate positioned about each of the product rows and comprising a base with a substantially vertical door extending therefrom configured to partially rotate about a substantially vertical axis from a closed position preventing access to the products in the respective product row to an open position allowing access to one of the products in the respective product row;

a product gate system positioned about each of the product gates and configured to prevent access to a remainder of the products in the respective product row when the product gate is in the open position; and a product shelf locking system positioned about each of the product shelves and configured to allow partial rotation of one of the product gates of the respective product shelf from the closed position to the open position while restricting rotation of a remainder of the product gates of the respective product shelf, each of the product shelf locking systems comprising:

a rotatable cam attached to each of the product gates of the respective product shelf and configured to rotate therewith from a first position to a second position; and a cursor positioned between each pair of adjacent cams and configured to translate from a first position to a second position upon rotation of one of the cams from the first position to the second position, the cursors configured to restrict rotation of a remainder of the cams when the cursors are in the second position.

26. The vendor of claim 25, wherein each of the product gate systems comprises a plurality of pivoting levers configured to pivot from a first position to a second position upon partial rotation of the respective product gate from the closed position to the open position.

27. The vendor of claim 26, wherein each of the product gate systems further comprises one or more pivoting flaps configured to pivot from a first position to a second position upon pivoting of the levers from the first position to the second position, and wherein the flaps are configured to prevent access to the remainder of the products in the respective product row when the flaps are in the second position.

28. A vendor for vending a plurality of products, the vendor comprising:

a glass door cooler; and a vending device positioned within the cooler, the vending device comprising:

a plurality of product shelves, each of the product shelves comprising:

a plurality of product rows, each of the product rows configured to contain a plurality of products therein; and a product gate positioned about each of the product rows and comprising a base with a substantially vertical door extending therefrom configured to partially rotate from a closed position preventing access to the products in the respective product row to an open position allowing access to one of the products in the respective product row;

a product shelf locking system positioned about each of the product shelves and configured to allow partial rotation of one of the product gates of the respective product shelf from the closed position to the open position while restricting rotation of a remainder of the product gates of the respective product shelf; and a vertical shelf locking system in communication with the product shelf locking systems and configured to cooperate with the product shelf locking systems to allow partial rotation of one of the product gates of one of the product shelves while restricting rotation of the product gates of a remainder of the product shelves.

29. The vendor of claim 28, wherein each of the product shelf locking systems comprises a rotatable cam attached to each of the product gates of the respective product shelf and configured to rotate therewith from a first position to a second position.

30. The vendor of claim 29, wherein each of the product shelf locking systems further comprises a cursor positioned between each pair of adjacent cams and configured to translate from a first position to a second position upon rotation of one of the cams from the first position to the second position, and wherein the cursors are configured to restrict rotation of a remainder of the cams when the cursors are in the second position.

31. The vendor of claim 30, wherein each of the product shelf locking systems comprises an end cursor positioned about the respective product shelf and configured to translate from a first position to a second position, and wherein the vertical shelf locking system comprises a vertical slide positioned about each of the product shelves and configured to cooperate with the respective end cursor.

32. The vendor of claim 31, wherein the vertical slides are configured to allow translation of one of the end cursors of one of the product shelf locking systems from the first position to the second position while restricting translation of the end cursors of a remainder of the product shelf locking systems.

33. The vendor of claim 28, wherein the vending device further comprises a payment locking system in communication with the vertical shelf locking system.

34. The vendor of claim 28, wherein the vending device further comprises a payment locking system positioned about each of the product shelves.

* * * * *